US006406416B2

(12) United States Patent
Lindsay

(10) Patent No.: US 6,406,416 B2
(45) Date of Patent: Jun. 18, 2002

(54) COMBINATION FOLDER AND SEALER MACHINE

(75) Inventor: Timothy D. Lindsay, Dover, NH (US)

(73) Assignee: Bescorp Inc., Dover, NH (US)

( * ) Notice: Subject to any disclaimer, the term of this patent is extended or adjusted under 35 U.S.C. 154(b) by 0 days.

(21) Appl. No.: 09/861,505

(22) Filed: May 21, 2001

Related U.S. Application Data

(62) Division of application No. 09/326,299, filed on Jun. 4, 1999, now Pat. No. 6,264,592.

(51) Int. Cl.[7] ..... B31B 1/64

(52) U.S. Cl. ..... 493/216; 493/243; 493/264; 493/420; 156/384; 156/442.1

(58) Field of Search ..... 493/216, 243, 493/249, 264, 267, 420, 422; 156/384, 442.1, 442.2

(56) References Cited

U.S. PATENT DOCUMENTS 5,863,373 A * 1/1999 Traise et al. ..... 156/290
5,968,308 A * 10/1999 Lindsay ..... 156/312
6,080,251 A * 6/2000 Baker et al. ..... 493/421
6,080,259 A * 6/2000 Nadeau et al. ..... 493/421
6,086,698 A * 7/2000 Spitler ..... 493/421

* cited by examiner

*Primary Examiner*—Peter Vo
*Assistant Examiner*—Hemant M. Desai
(74) *Attorney, Agent, or Firm*—Donald Cayen

(57) ABSTRACT

A combination folder and sealer machine is much more compact than prior separate and individual folder and sealer machines. The combination folder and sealer machine comprises a folder station that grips a folded sheet simultaneously with a sealer station downstream of the folder station. The sheet is thus under complete control as it is propelled from the folder station to the sealer station, thereby eliminating any skewing that might occur between the two stations. Folding rollers at the folder station are biased toward each other, but the sealing rollers at the sealing station are biased away from each other. A single motor drives the folder and sealer stations as well as a feeder station. Drive trains for the sealer and folder stations are on opposite sides of the machine. A bearing mechanism enables any folding roller to be removed from the machine without removing any other roller and without affecting the machine side walls.

9 Claims, 6 Drawing Sheets

FIG. 8
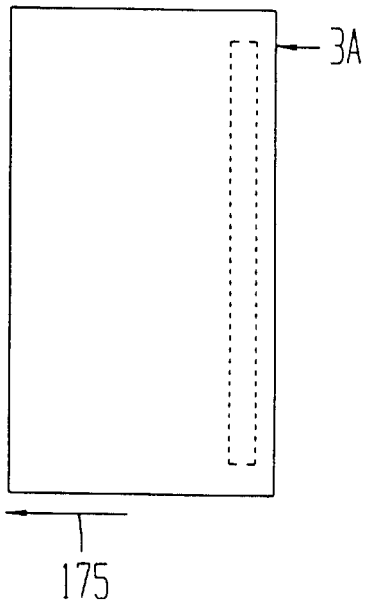
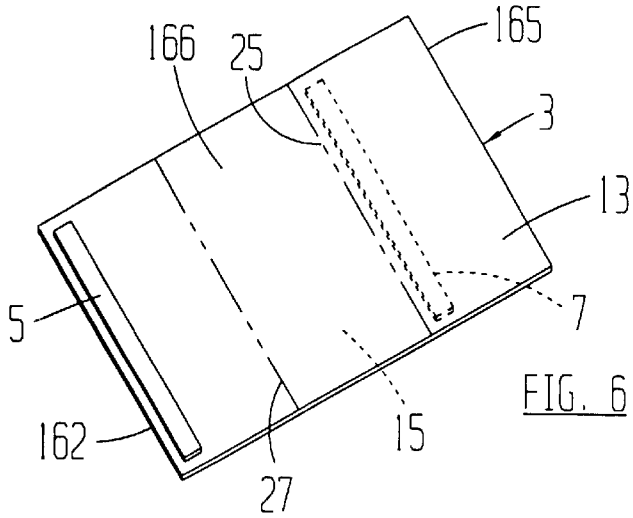
FIG. 6
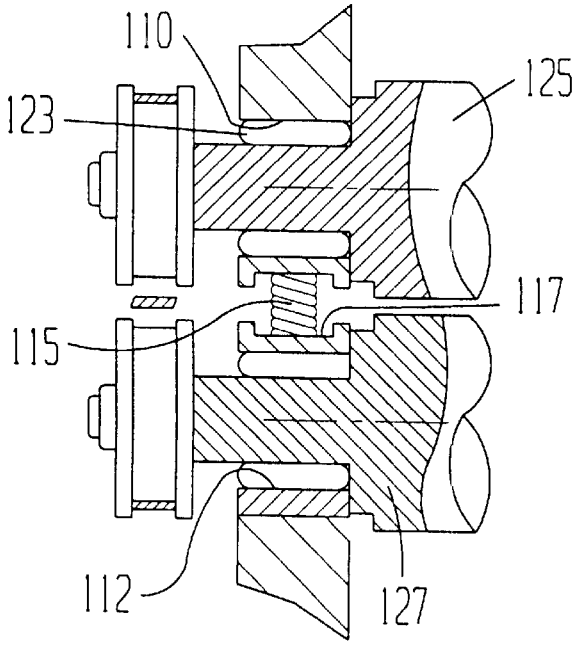
FIG. 5
FIG. 7
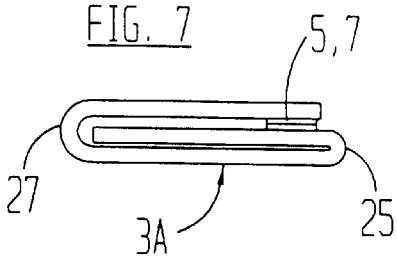

COMBINATION FOLDER AND SEALER MACHINE

This application is a divisional of U.S. patent application Ser. No. 09/326,299 filed Jun. 4, 1999, now U.S. Pat. No. 6,264,592.

BACKGROUND OF THE INVENTION

1. Field of the Invention

This invention pertains to paper handling, and more particularly to apparatus that processes business forms.

2. Description of the Prior Art

A wide variety of machinery has been developed to handle printed forms on a commercial basis. For example, machines that fold sheets of paper into different configurations are well known and in widespread use. Such machines, usually called "folders", are capable of creating C, V, Z, eccentric C, eccentric Z, and double parallel folds in paper sheets at high speeds.

It is also well known to seal the folded sheets each to itself. For that purpose, strips of adhesive are applied at desired locations on the sheets. The modern tendency is to use pressure sensitive adhesives. After a sheet with pressure sensitive adhesive strips has been folded, it is fed to a sealer machine. In the sealer machine, pressure is applied to the adhesive strips. The applied pressure activates the adhesive and causes the sheet to adhere to itself along the strips. Exemplary pressure sealer apparatus is shown in U.S. Pat. No. 5,772,841 assigned to Bescorp Inc. of Dover, N.H.

In the past, folders and pressure sealer machines were normally distinct and independent pieces of equipment. Although certain models of pressure sealers were especially compatible with certain models of folders, a folder-sealer machine installation usually required custom engineering to make the two machines work together properly. In addition, the prior individual folders and pressure sealers were relatively expensive. They were also bulky and heavy. Consequently, purchasing and installing prior folder and sealer machines was a costly and time consuming project.

Another major disadvantage of prior folder and sealer machines is that the forms were under little, if any, control as they passed from the folder to the sealer machine. Usually, the folded forms emerged from the folder onto a conveyor belt, which transported them to the sealer. While on the conveyor belt, friction was often the only means used to maintain the forms at the desired alignment necessary for proper input into the sealer. The result was that the forms could skew as they traveled to the sealer. Some conveyors had wheels that rode on top of the forms to help keep them properly aligned. The top wheels, however, did not completely prevent the forms from skewing. A skewed form would jam the sealer and cause a pile-up of forms upstream, which required unproductive down time to clear.

In addition to the mentioned problems pertaining to folder and sealer equipment as used together, there was a disadvantage of prior folders themselves. That disadvantage pertained to the mounting of the folding rollers in the machine frame. In many designs, the folding rollers, once installed, were very difficult to remove. Hence, replacing worn or damaged folding rollers was a time consuming chore.

Moore Business Forms, Inc. of Grand Island, N.Y., markets a compact folding and sealing mailing system under the trademark SpeediSealer. Although the Moore machine possesses several desirable features, there nevertheless is considerable room for further improvement to folding and sealing equipment.

SUMMARY OF THE INVENTION

In accordance with the present invention, a combination folder and sealer machine is provided that maintains continuous control over sheets processed by the machine. This is accomplished by apparatus that includes a fold nip and a seal nip that simultaneously grip each sheet while the sheets are being processed.

Unfolded sheets are stacked at a feeder station. The sheets are fed one at a time in a downstream direction to a folder station. The sheets pass through the rollers of a first nip at the folder station and into a first fold chute. The first fold chute cooperates with the rollers of the first nip to send the sheets through the rollers of a second nip and simultaneously produce a first fold in the sheet. The rollers of the second nip propel the partially folded sheet to a second fold chute. While the sheet is at the second fold chute, the rollers of a third nip grip the sheet and send it through the third nip, which produces a second fold. From the third nip, the fully folded sheet is propelled further in the downstream direction. In addition to producing the second fold in the sheet, the rollers of the third nip also partially activate strips of pressure sensitive adhesive on the sheet so as to loosely seal the sheet to itself.

While the trailing portion of the fully folded and partially sealed sheet is still gripped in the third nip of the folder station, the sheet leading portion is received in a nip at a sealer station. The rollers of the sealer station nip complete activation of the pressure sensitive adhesive, such that the sheet becomes fully sealed. The rollers of the seal nip propel the sheet out of the combination folder and sealer machine as a completed business form. Because the folded and partially sealed sheet is received at the sealer station before it is completely released from the folder station, the sheet is under complete control by the machine at all times. Consequently, the sheets do not become skewed as they are propelled from the folder station to the sealer station. Further, the fact that the sealer station is so close to the folder station considerably decreases the size of the combination folder and sealer machine compared with prior functionally equivalent equipment.

It is a feature of the invention that the rollers of the sealer station nip are biased away from each other, while the rollers of the folder station nips are biased toward each other. The sealer station rollers are adjustably set to a fixed clearance that suits a particular sheet and the strips of pressure sensitive adhesive applied to the sheet. Springs bias the sealing rollers away from each other to maintain the clearance. Because the sealer station rollers never touch each other, they do not wear on each other nor do they produce heat. Further, their operation is quieter than other pressure sealing machines.

Further in accordance with the present invention, the rollers at the folder station are mounted in the machine frame by a mounting system that renders the folding rollers exceptionally easy to remove and replace. Further, the folding roller mountings are designed to bias the folding rollers toward each other in a controllable manner.

The folding roller mounting system comprises two spacer plates that are mounted to opposite side walls of the machine frame. Each spacer plate has holes that are partially aligned with openings in the frame side walls associated with the respective folding rollers. The roller core ends are supported in bearing plates that are secured to the spacer plates. To remove a selected roller, it is necessary only to remove a spacer plate from one of the frame side walls. The selected roller is pulled from one end through the associated opening in the frame side wall. Simultaneously, the opposite end of the roller is pulled from the bearing plate at the other frame side wall. In that manner, the selected roller is removed from the machine without removing the other rollers and without affecting the machine side walls.

The method and apparatus of the invention, using easily replaceable folding rollers at a folder station that grip a folded sheet simultaneously with a sealer station, thus considerably reduces the size and weight of the combination folder and sealer machine as compared with prior equipment. The probability that a sheet will become skewed during the folding and sealing process is very low, even though the machine operates continuously at high speed.

Other advantages, benefits, and features of the present invention will become apparent to those skilled in the art upon reading the detailed description of the invention.

BRIEF DESCRIPTION OF THE DRAWINGS

FIG. 5 is a cross-sectional view taken along line 5—5 of FIG. 4.

FIG. 6 is a perspective view of a typical sheet that is advantageously processed by the combination folder and sealer machine of the invention.

FIG. 7 is an end view of the sheet of FIG. 6 after it has been folded.

FIG. 8 is a top view of the sheet of FIG. 7.

DETAILED DESCRIPTION OF THE INVENTION

Figure 1:
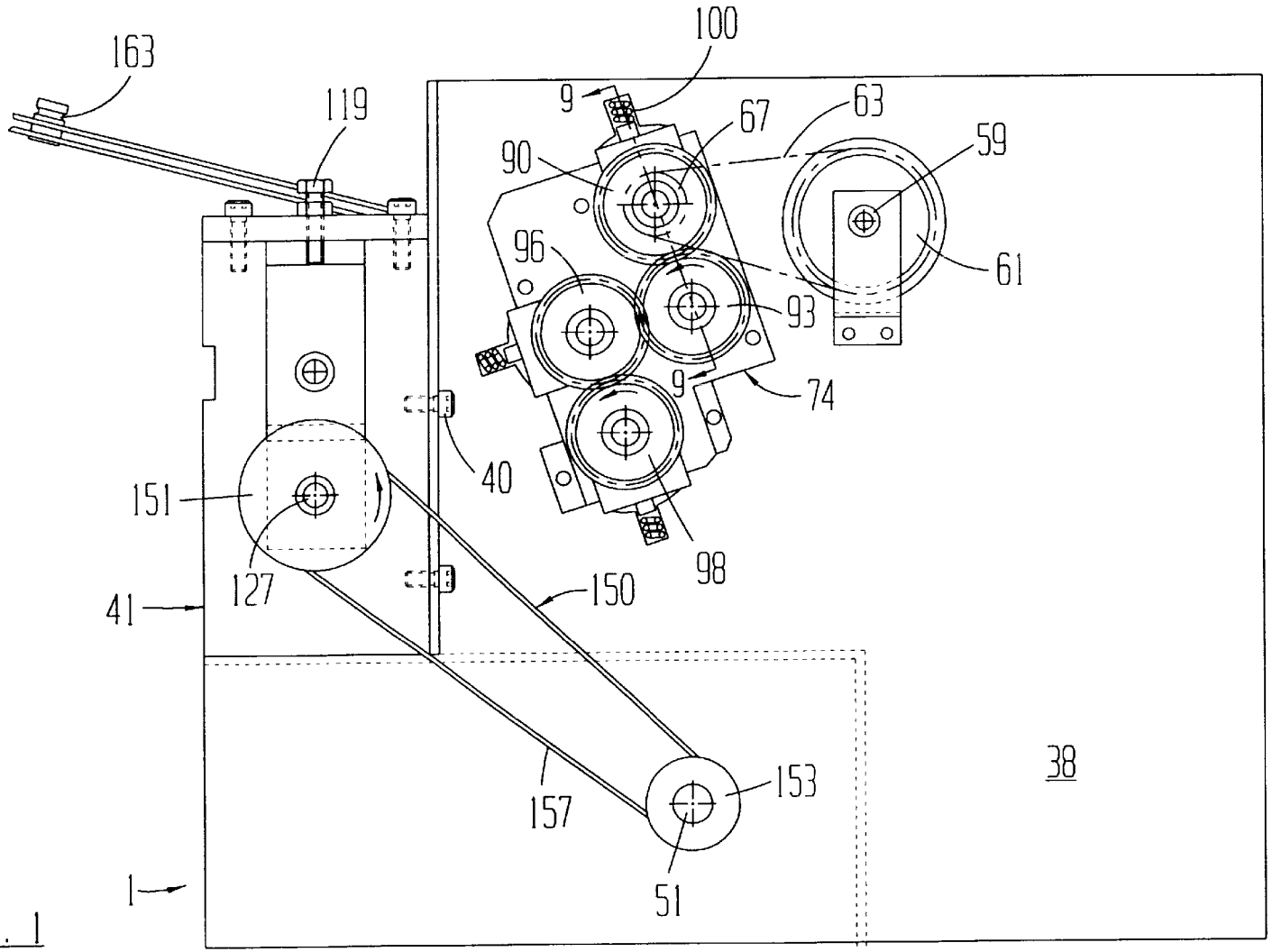
FIG. 1 is a front view of the combination folder and sealer machine of the invention.

Although the disclosure hereof is detailed and exact to enable those skilled in the art to practice the invention, the physical embodiments herein disclosed merely exemplify the invention, which may be embodied in other specific structure. The scope of the invention is defined in the claims appended hereto.

General

Referring first to FIGS. 1–5, reference numeral 1 indicates the combination folder and sealer machine of the invention. The combination folder and sealer machine 1 processes thin sheets of flexible material, such as sheets of paper, by first folding them along predetermined fold lines, and then sealing the folded sheet to itself along strips of adhesive. A particularly important application of the combination folder and sealer machine is the processing of business forms including marketing pieces and payroll checks.

FIGS. 6–8 show a typical sheet of paper 3 having opposite surfaces 13 and 15. Strips 5 and 7 of pressure sensitive adhesive are applied to the surfaces 13 and 15, respectively, at desired locations. In the combination folder and sealer machine 1, the sheet 3 is folded along fold lines 25 and 27 into a C folded sheet 3A. The folded sheet 3A is then sealed to itself along the adhesive strips 5 and 7.

The particular sheet 3 and pressure sensitive adhesive strips 5 and 7 shown are merely representative of a wide variety of sheet configurations and adhesive patterns that can be processed by the combination folder and sealer machine 1. It will therefore be understood that the invention is not limited to use with any particular type of sheet or adhesive pattern. Moreover the C folded sheet 3A is just one of several types of folds that can be made in a sheet. For example, the combination folder and sealer machine 1 can also fold sheets into V, Z, eccentric C, and eccentric Z folds.

Figure 4:
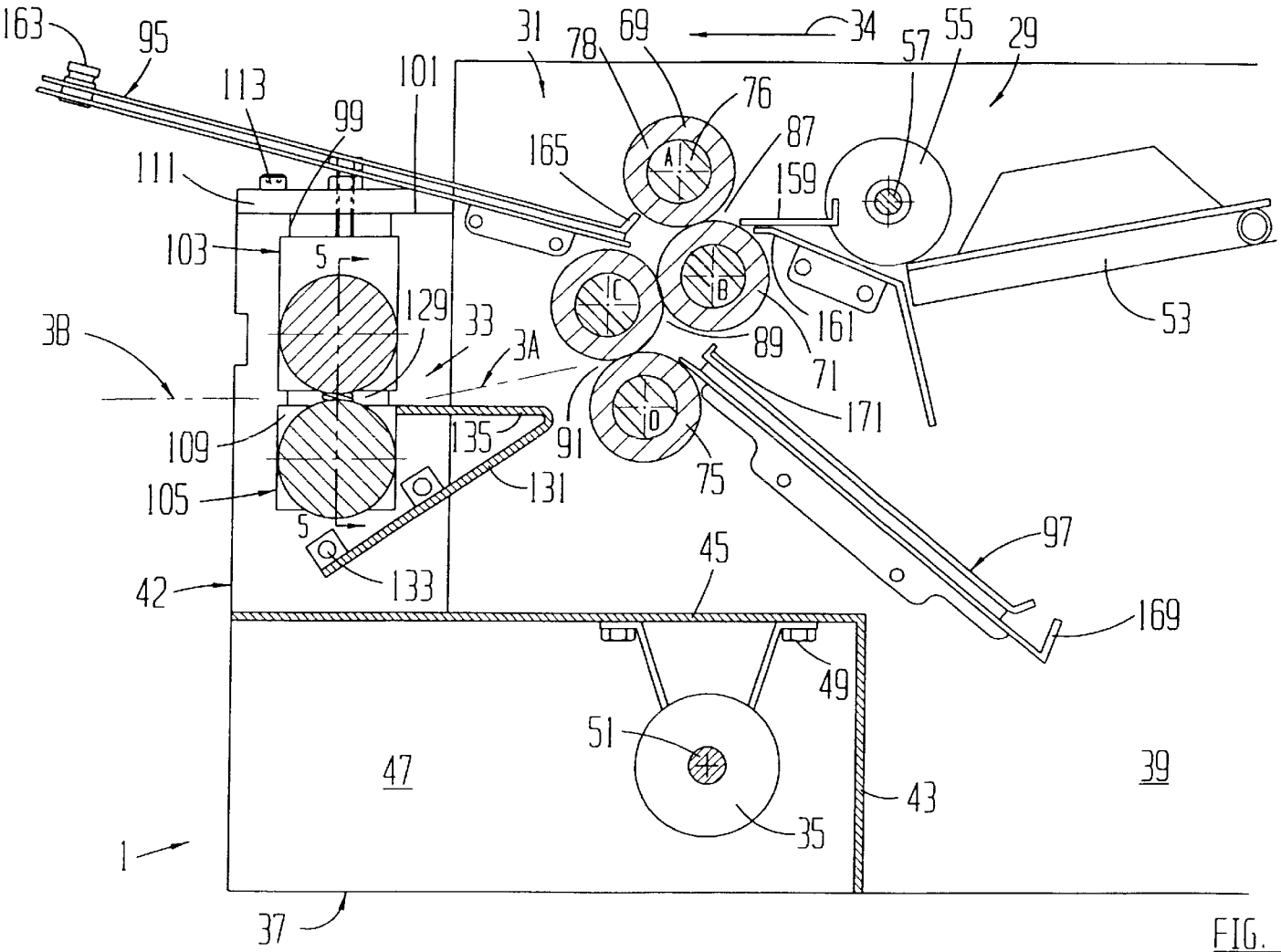
FIG. 4 is a cross-sectional view taken along line 4—4 of FIG. 2.
Figure 12:
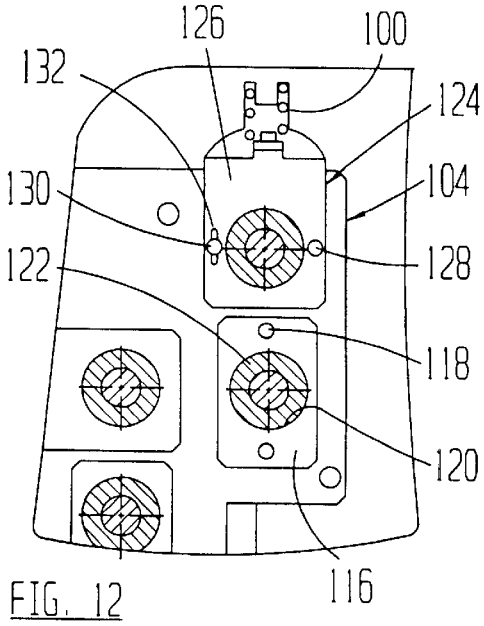
FIG. 12 is a cross-sectional view taken along line 12—12 of FIG. 9.
Figure 10:
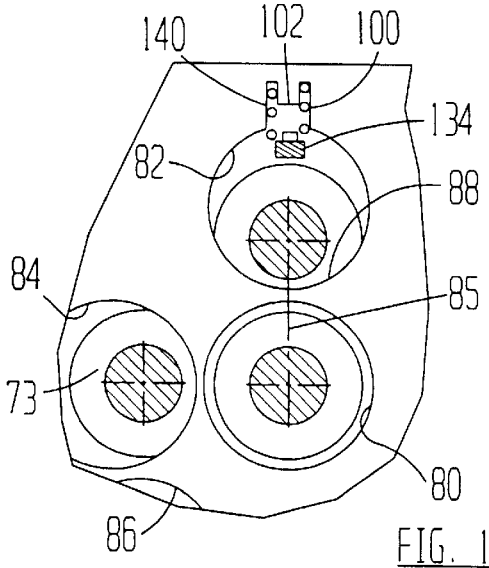
FIG. 10 is a cross-sectional view taken along line 10—10 of FIG. 9.
Figure 11:
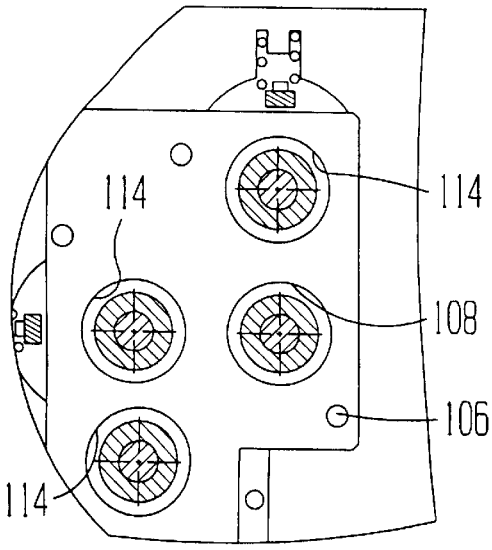
FIG. 11 is a cross-sectional view taken along line 11—11 of FIG. 9.
Figure 9:
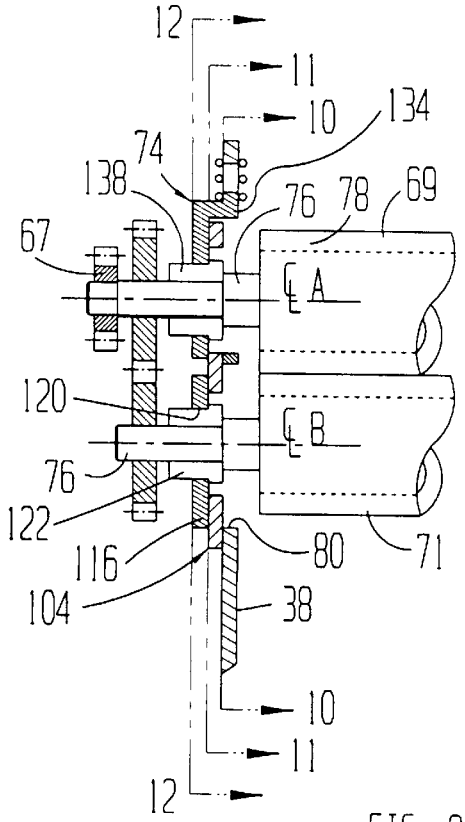
FIG. 9 is a cross-sectional view taken along line 9—9 of FIG. 1.

With particular attention to FIG. 4, the combination folder and sealer machine 1 has three stations: a feeder station 29, a folder station 31, and a sealer station 33. A stack of unfolded sheets 3 is stored at the feeder station 29. The feeder station supplies the sheets one at a time in a downstream direction 34 to the folder station 31. At the folder station, the sheets are folded into the sheets 3A. From the folder station, the sheets 3A are propelled in the downstream direction 34 to the sealer station 33. At the sealer station, the folded sheets 3A are sealed into completed business forms 3B. All of the folding and sealing functions of the combination folder and sealer machine are performed through the power supplied by a single electric motor 35, as will be explained in detail shortly.

Construction

The combination folder and sealer machine 1 is constructed with a compact frame 37. In the illustration construction, the frame 37 has a pair of side walls 38 and 39. The side walls 38 and 39 are attached, as by screws 40, to respective side plates 41 and 42. The frame further comprises cross walls 43 and 45 between the side walls. The cross walls 43 and 45 cooperate to form a lower chamber 47. The side plates 41 and 42 rest on the wall 45. The motor 35 is located in the chamber 47 and is fastened to the wall 45 by nuts and bolts 49. The motor armature shaft 51 passes through the frame side wall 38.

The feeder station 29 may be generally conventional. A typical and satisfactory feeder station is Uchida Model 330/370. Briefly, a supply of sheets 3 is stored on a spring loaded infeed tray 53. The sheets are unfolded and lie flat on the infeed tray 53. One or more pick-up wheels 55 are on a long shaft 57 that is supported on the frame side walls 38 and 39. The pick-up wheels 55 ride on the sheets above a gate tip next to the tray 53. There is a paper separator, not shown, adjacent the pick-up wheels and the gate tip. On the end of the shaft 57 outside the wall 38 is an over-running or one-way bearing 59, on which is assembled a sprocket 61. A chain 63 is trained around the sprocket 61.

The chain 63 is also trained around a sprocket 67 on the end of a first folding roller 69 at the folder station 31. There are four folding rollers at the folder station 31: rollers 69, 71, 73, and 75. For convenience, the longitudinal centerlines of the folding rollers 69, 71, 73, 75 will be designated as centerlines A, B, C, and D, respectively. Each of the folding rollers is comprised of a steel core 76 and a rubber covering 78. Centerline B of roller 71 is stationarily located relative to the frame side walls 38 and 39. The other three folding rollers 69, 73, and 75 are moveable relative to the frame side walls. Specifically, centerline A is moveable toward and away from centerline B; centerline C is moveable toward and away from centerline B; and centerline D is moveable toward and away from centerline C.

Also in accordance with the present invention, the combination folder and sealer machine 1 further comprises a bearing system 74 that enables any of the folder station rollers to be easily removed from the frame 37 with minimum disturbance to the other folding rollers and without affecting the machine side walls 38 and 39. Looking also at FIGS. 9–12, the bearing system 74 will be described. Each side wall 38 and 39 has a opening 80 therethrough aligned with centerline B. The size of the openings 80 is larger than the diameter of the roller 71. Each frame side wall also has a trio of substantially similar openings 82, 84, 86 associated with centerlines A, C, D, respectively. Each opening 82, 84, 86 has an arcuate section 88 that intersects a rectangular section 100. The rectangular sections 100 are centered on the line between two adjacent roller centerlines. That is, the rectangular section of the opening 82 is on the line 85 between centerlines A and B; the rectangular section of the opening 84 is on the line between the centerlines B and C; and the rectangular section of the opening 86 is on the line between the centerlines C and D. The blind end of each rectangular section has a short tab 102. The diameter of the arcuate sections is larger than the diameter of the rollers 69, 73, 75. The arcuate sections are not concentric with the associated folding roller centerlines A, C, or D, but rather are displaced in the direction toward the associated rectangular sections.

A spacer plate 104 is mounted to each frame side wall 38 and 39 by fasteners 106. Each spacer plate 104 has a hole 108 aligned with centerline B, and similar holes 114 aligned with each of the centerlines A, C, and D. The holes 108 and 114 have respective diameters that are larger than the diameter of the folding roller cores 76 but smaller than the diameter of the roller covers 78. A fixed bearing plate 116 is fastened to each spacer plate 104 by fasteners 118. The fixed bearing plates 116 have respective holes 120 that are aligned with centerline B. A bearing 122 in each fixed bearing plate 116 rotatably supports an end of the roller core 76.

A moveable bearing plate 124 is associated with each of the centerlines A, C, D on each side wall 38 and 39. Each moveable bearing plate 124 has a flat region 126 that is in facing contact with the spacer plate 104. A first fastener 128 secures the moveable bearing plate to the spacer plate at the location of the fastener. A second fastener 130 passes through a slot 132 in the moveable bearing plate. The slot 132 enables the moveable bearing plate to pivot in an arc about the first fastener 128. An L-shaped finger 134 bends from one end of the moveable bearing plate flat region 126 and fits in the rectangular section 100 of the associated opening 82, 84, 86 in the side wall. Each moveable bearing plate receives a bearing 138 that supports one end of the core 76 of the associated folding roller 69, 73, or 75. A compression spring 140 is inserted between the tab 102 in the side wall and the moveable bearing plate finger 134.

When the fasteners 128 and 130 are loosened, the springs 140 urge the associated pairs of folding rollers toward each other and into contact to form three spring-loaded nips: an input nip 87 between rollers 69 and 71; an intermediate nip 89 between the rollers 71 and 73; and an output nip 91 between rollers 73 and 75, FIG. 4. Also at the folder station 31 is a first fold chute 95 and a second fold chute 97, both of which are fastened to the frame side walls 38 and 39. On the end of the folding rollers 69, 71, 73, 75 on the outside of the frame wall 38 are identical gears 90, 93, 96, 98, respectively. The gears 90 and 93 on centerlines A and B, respectively, mesh with each other; the gears 93 and 96 on centerlines B and C, respectively, mesh with each other; and the gears 96 and 98 on centerlines C and D, respectively, mesh with each other. On the roller 71 outside the frame side wall 39 is a pulley 94.

Figure 2:
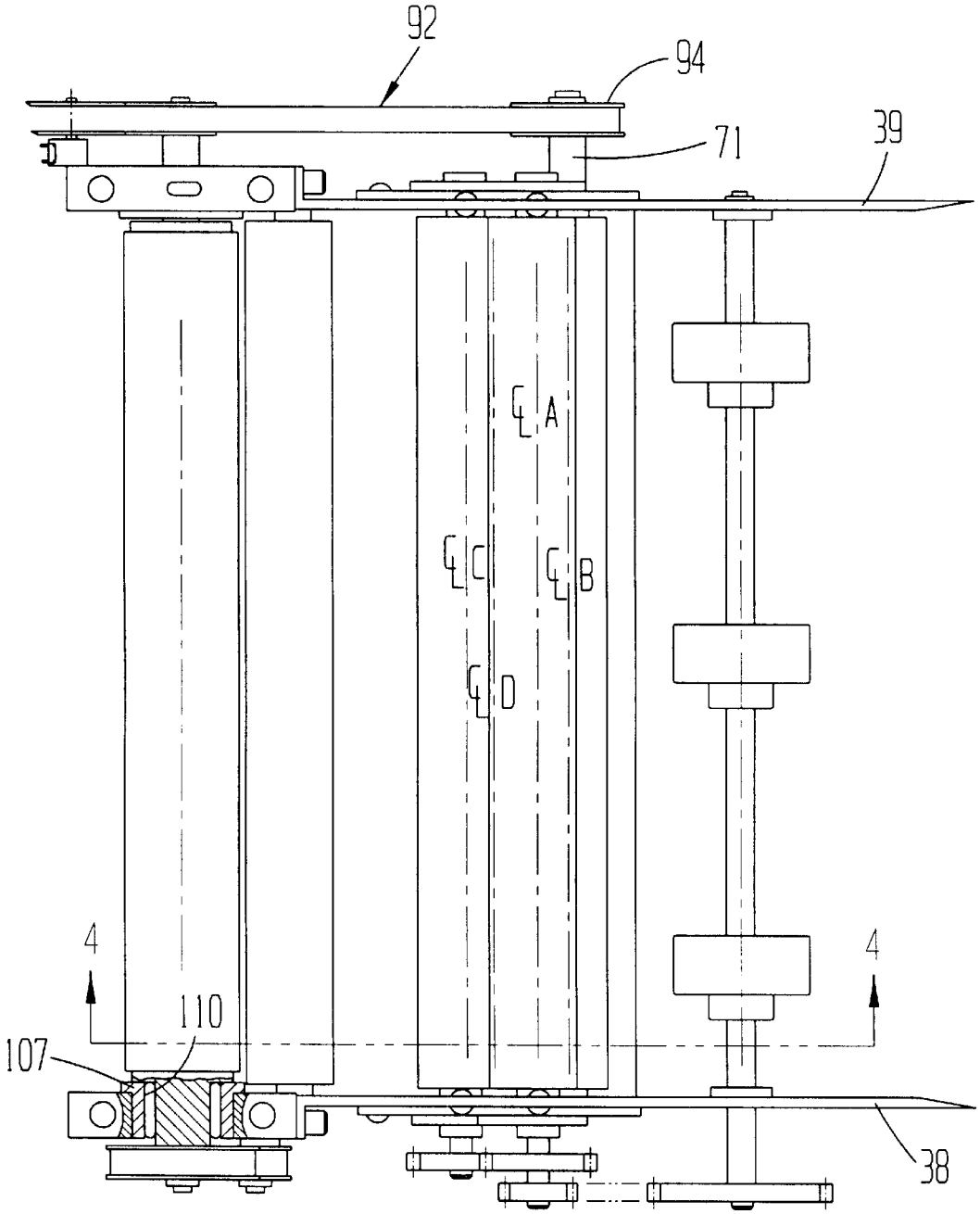
FIG. 2 is a top view of FIG. 1.
Figure 3:
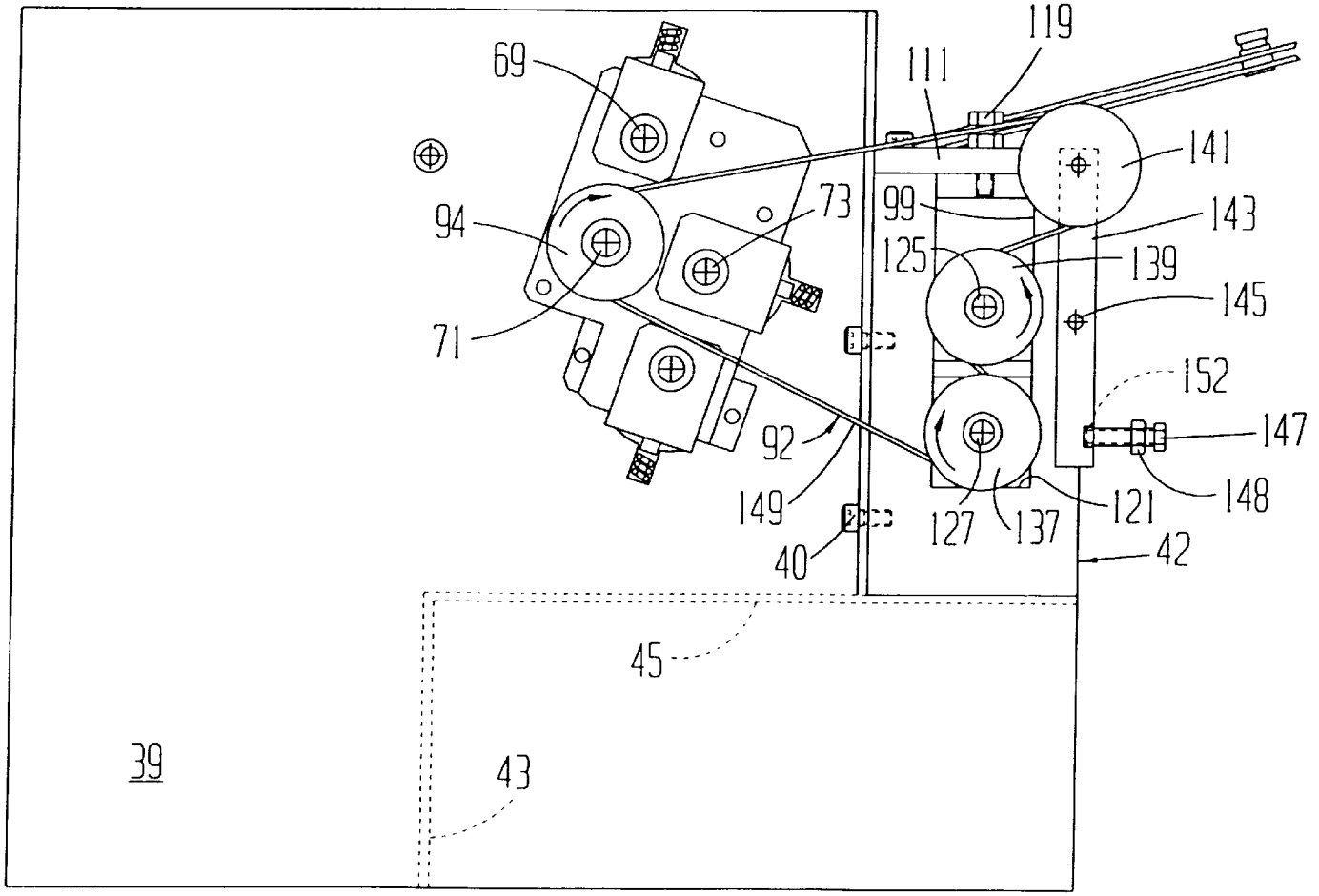
FIG. 3 is a back view of FIG. 1.

The sealer station 33 includes the side plates 41 and 42. There is a slot 99 in each side plate that extends from the side plate top surface 101. Slideingly received in each slot 99 are upper and lower bearing blocks 103 and 105, respectively. Both bearing blocks 103 and 105 have oppositely extending flanges 107 and 109, respectively. The bearing blocks thus have generally T-shapes, as is best seen in FIG. 2. The flanges 107 and 109 guide the bearing blocks in the side plates. There is a bore 110 in the upper bearing block, and a similar bore 112 in the lower bearing block. A cap 111 is mounted by screws 113 to the top surface 101 of each side plate.

Interposed between the upper and lower bearing blocks 103 and 105, respectively, in each side plate 41 and 42 is a compression spring 115. The springs 115 preferably sit within counterbores 117 in the bearing blocks. Adjustment screws 119 are threaded into each cap 111 and bear against the associated upper bearing blocks.

The adjustment screws 119 and the springs 115 cooperate to locate the bearing blocks 103 and 105 relative to each other. Specifically, the springs 115 bias the bearing blocks away from each other. The lower bearing blocks contact the bottom surfaces 121 of the end plate slots 99. The lower bearing blocks are thus located at fixed locations. The adjustment screws locate the upper bearing blocks. By adjusting the adjustment screws, the locations of the upper bearing blocks are set. Consequently, the center distance between the bores 110 and 112 in the bearing blocks is also adjusted by the adjustment screws.

Rotatably mounted in the bores 110 of the two upper bearing blocks 103 by means of roller bearings 123 is an upper sealing roller 125. Similarly, there is a lower sealing roller 127 between the bearing blocks 105. The sealing rollers 125 and 127 cooperate to form a seal nip 129. In FIGS. 4 and 5, the sealing roller clearance in the seal nip 129, as set by the adjustment screws 119 and springs 115, is shown exaggerated for clarity.

There is a crosspiece 131 proximate the seal nip 129. The crosspiece 131 is joined to the side plates 41 and 42 by screws 133. The crosspiece has a horizontal surface 135.

Outside of the combination folder and sealer machine 1 adjacent the side wall 39 is a folder drive train 92. In the illustrated construction, the folder drive train 92 is comprised of a pulley 137 on the end of the lower sealing roller 127 outside of the side plate 42. There is a similar pulley 139 on the upper sealing roller 125. An idler pulley 141 is rotatable on an arm 143. The arm 143 is adjustable on the side plate 42 by means of a pivot screw 145 and a jack screw 147. The jack screw 147 threads into a small lug 148 that is part of a side cover, not shown, for the machine. The end of the shank of the jack screw enters a clearance counterbore 152 in the arm 143. A belt 149 is trained around the pulleys 94, 137, 139, and 141. Rotating the jack screw in the lug 148 rotates the arm 143 about the fixed fastener 145 to provide adjustability to the tension in the belt 149.

A sealer drive train 150 is located outside of the frame side wall 38. The sealer drive train 150 is comprised of a pulley 151 on the end of the lower sealing roller 129 outside the side plate 41. There is another pulley 153 on the motor shaft 51 outside of the frame side wall 38. A belt 157 is trained around the pulleys 151 and 153.

As mentioned, mechanical power to the combination folder and sealer machine 1 is provided by the motor 35. Energizing the motor causes the lower sealing roller 127 to rotate by means of the belt 157 and the pulleys 151 and 153. The lower sealing roller drives the upper sealing roller 125 through the belt 149 and the pulley 139. Simultaneously, the pulley 137 rotates the pulleys 141 and 94. Consequently, the folding roller 71 is driven by the lower sealing roller and the belt 149. The folding rollers 69 (centerline A) and 73 (centerline C) are driven by the gears 90, 93, and 96. The folding roller 75 (centerline D) is driven by the gears 96 and 98.

The springs 100 provide sufficient normal forces at the nips 87, 89, 91 to assure satisfactory operation of the folder station 31. The folding roller 69 drives the pick-up wheels 55 through the chain 63. In the practice of my invention, I prefer that the diameter of the sealing rollers 69, 71, 73, 75 be slightly greater than the diameter of the folding rollers 125, 127. However, the various gears, sprockets, and rollers are designed such that the surface speeds of all the folding and sealing rollers are equal.

Operation

The combination folder and sealer machine 1 operates to fold and seal sheets, such as sheet 3 shown in FIG. 6, on a high-speed and reliable basis. With the folding rollers 69, 71, 73, 75 and the sealing rollers 125, 127 rotating with equal surface speeds, the pick-up wheels 55 cooperate with the paper separator to feed one sheet at a time from the stack on the tray 53 to the folder station input nip 87. The sheet is guided to the nip 87 by guide plates 159 and 161. After the leading edge 162 of the sheet (FIG. 6) has passed through the nip 87, it enters the first fold chute 95 and strikes a stop 163. The stop 163 is adjustable along the length of the first fold chute to create different types of folds in the sheet, as is known in the art. The leading edge 162 of the sheet strikes the stop before the sheet trailing edge 165 has passed through the nip 87. Consequently, the sheet bends in the interior 166 between the leading and trailing edges. A deflector 165 on the fold chute assures that the sheet interior 166 bends downwardly toward the intermediate nip 89. The sheet interior is pulled through the nip 89 in a manner that folds the sheet along the first fold line 25. The fold line 25 becomes the leading edge of the sheet, and the edge 162 becomes the trailing edge, and the sheet enters the second fold chute 97. A stop 169 limits travel of the new leading edge 25 such that the new trailing edge 162 is still in the nip 89 after the leading edge has struck the stop. The nip 89 continues to propel the sheet and causes it to bend between the leading edge 25 and the trailing edge 162. A deflector 171 on the second fold chute assures that the sheet bends toward the output nip 91. The output nip 91 pulls the sheet through it in a manner that creates the second fold line 27. The sheet is then folded to the configuration 3A of FIGS. 7 and 8. The fold line 27 becomes the new leading edge of the sheet as it is propelled through the nip 91. In FIG. 8, arrow 175 indicates the direction in which the folded sheet 3A is propelled. In addition to producing the fold line 27 in the sheet, the output nip also initially activates the pressure sensitive adhesive in the strips 5 and 7.

From the folder station output nip 91, the folded sheet 3A is propelled to the sealer station 33. The crosspiece 131 assures that the sheet 3A is properly guided to the seal nip 129.

It is an important feature of the invention that the folded sheet is under complete and positive control as it is propelled from the folder station 31 to the sealer station 33. Such control is achieved by constructing the seal nip 129 to be close enough to the output fold nip 91 such that the sheet 3A is gripped in both nips simultaneously. That is, the sheet leading edge 27 enters the nip 129 before the sheet trailing edge 25 leaves the nip 91. That action prevents any skewing of the sheet 3A between the folder and sealer stations and is a major advance in the forms processing art.

At the sealer station 33, the seal nip 129 is set to exert a predetermined pressure on the pressure sensitive adhesive strips 5 and 7 on the sheet 3A (FIG. 7). Specifically, the clearance between the sealing rollers 125 and 127 is set at a sufficiently close spacing so as to fully activate and cause adhesion of the pressure sensitive adhesive strips. In a typical business form, the clearance between the sealing rollers is set at approximately 0.001 inches. That setting is made by adjusting the adjustment screws 119. The springs 115 hold the sealing rollers apart at the clearance set by the adjustment screws. Jam nuts on the adjustment screws maintain the desired setting. Because of the springs, the sealing rollers never touch each other, thereby eliminating noise, wear, and heat. The sheet 3B, folded and sealed, emerges from the combination folder and sealing machine 1 as a complete business form ready for any further processing.

The design of the combination folder and sealer machine 1 that provides complete control of the sheet 3A between the folder station 31 and the sealer station 33 is related to the compact nature of the entire machine. The presence of just one seal nip 129 further contributes to the small size of the machine. In turn, the need for a single seal nip is made possible by the use of the folder station output nip 91 to initially activate the sheet pressure sensitive adhesive strips 5 and 7.

As mentioned, the bearing system 74 enables a selected folding roller 69, 71, 73, or 75 to be easily and quickly removed from the machine 1. That is achieved by removing the fasteners 106 from the spacer plate 104 that is mounted to the machine side wall 39. The pulley 94 is removed from the roller 71. The loosened spacer plate is pulled away from the machine side wall 39, simultaneously pulling the bearings 122 and 138 off all four folding rollers. Alternately, the bearing plates 116 and 124 can be removed from the spacer plate before the spacer plate is removed. The gear 90, 93, 96, or 98 is disassembled from the roller that is to be removed. If the roller 69 is to be removed, the sprocket 67 is disassembled from that roller. The selected roller is pulled through the associated opening 80, 82, 84, or 86 in the frame side wall 39, simultaneously pulling the selected roller out of the bearing 122 or 138 at the frame side wall 38. The other rollers can remain in the machine 1 while the removed roller is replaced. In that manner, the non-removed rollers undergo minimal disturbance, and the machine side walls are not affected at all during a folding roller replacement.

In summary, the results and advantages of prior folder machines and sealer machines can now be more fully realized. The combination folder and sealer machine 1 provides complete control of a sheet of paper from the feeder station 29 until the finished sheet 3B emerges from the sealer station 33. This desirable result comes from using the combined functions of the folder station output nip 91 and the seal nip 129. Those nips are constructed such that the partially processed sheet 3A is received in the seal nip 129 before it has left the output fold nip 91. The seal nip is adjustable to suit different business forms without affecting the performance of the folder station 31. A further benefit of the sheet control aspect is that the machine is of much reduced size, weight, and cost compared with prior individual folder and sealer machines. Consequently, the combination folder and sealer machine is readily portable to different job sites to suit different form processing needs. The folder station bearing system 74 enables any of the folding rollers 69, 71, 73, 75 to be removed from the machine with minimum disturbance to the other rollers. The bearing system also provides forces that bias pairs of the folding rollers toward each other to form the nips 87, 89, 91.

It will also be recognized that in addition to the functional and operational features and benefits of the combination folder and sealer machine, its construction is such that it is economical both to construct and operate. The simplicity of design assures a long service life with minimal maintenance.

Thus, it is apparent that there has been provided, in accordance with the invention, a combination folder and sealer machine that fully satisfies the aims and advantages set forth above. While the invention has been described in conjunction with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

I claim:

1. A method of processing sheets having pressure sensitive adhesive strips thereon into business forms comprising the steps of:

a. feeding the sheets one at a time to a folder station;

b. folding the sheets into a predetermined configuration at the folder station;

c. propelling the folded sheets one at a time from the folder station to a sealer station;

d. gripping a second portion of a folded sheet simultaneously at the folder station while a first portion of the folded sheet is at the sealer station and thereby preventing the sheet from skewing as it is propelled from the folder station to the sealer station; and e. sealing the folded sheet to itself at the sealer station into a completed business form.

2. The method of claim 1 wherein:

a. the step of folding the sheet comprises the step of initially activating the pressure sensitive adhesive strips; and b. the step of sealing the folded sheet comprises the step of completely activating the pressure sensitive adhesive strips.

3. The method of claim 1 wherein:

a. the step of sealing the folded sheet comprises the step of providing a motor and driving a sealer drive train with the motor to operate the sealer station; and b. the step of folding the sheet comprises the step of driving a folder drive train with the sealer station to operate the folder station.

4. The method of claim 3 wherein:

a. the step of feeding the sheets comprises the step of providing a combination folder and sealer machine having upstanding side walls;

b. the step of driving a sealer drive train comprises the step of providing a sealer drive train outside of a first side wall; and c. the step of driving the folder drive train comprises the step of providing a folder drive train outside of a second side wall.

5. The method of claim 1 wherein the step of sealing the folded sheet comprises the steps of:

a. setting a predetermined clearance between a pair of sealing rollers;

b. biasing the sealing rollers away from each other to the predetermined clearance; and c. propelling the folded sheet through the predetermined clearance of the sealing rollers and thereby producing a completed business form.

6. The method of claim 5 wherein the step of biasing the sealing rollers away from each other comprises the steps of:

a. mounting the sealing rollers in respective pairs of bearing blocks; and b. biasing the respective pairs of bearing blocks away from each other.

7. The method of claim 6 wherein the step of setting a predetermined clearance comprises the steps of:

a. slideingly receiving the pairs of bearing blocks in a frame; and b. adjusting adjustment screws in the frame to limit sliding of the bearing blocks away from each other to the predetermined clearance.

8. The method of claim 1 wherein:

a. the step of feeding the sheets comprises the step of providing a combination folder and sealer machine having first and second upstanding side walls; and b. the step of folding the sheets comprises the steps of:

i. providing a plurality of folding rollers at the folder station; and ii. removing a selected folding roller from the combination folder and sealer machine without removing any of the other folding rollers and without affecting the machine side walls.

9. The method of claim 8 wherein:

a. the step of providing a plurality of folding rollers comprises the steps of:

i. mounting first and second spacer plates to the first and second machine side walls, respectively;

ii. securing a bearing plate associated with each of the folding rollers to each spacer plate; and iii. supporting the folding rollers in the bearing plates; and b. the step of removing a selected folding roller comprises the steps of:

i. removing the first spacer plate from the machine first side wall; and ii. removing the selected folding roller through the machine first side wall.

* * * * *